US011098542B2

(12) United States Patent
Provost et al.

(10) Patent No.: US 11,098,542 B2
(45) Date of Patent: Aug. 24, 2021

(54) ANCHOR AND METHOD FOR MAKING

(71) Applicants: Wilfred Provost, Tomball, TX (US); Andres Sosa, Spring, TX (US)

(72) Inventors: Wilfred Provost, Tomball, TX (US); Andres Sosa, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 123 days.

(21) Appl. No.: 16/195,074

(22) Filed: Nov. 19, 2018

(65) Prior Publication Data

US 2020/0157899 A1 May 21, 2020

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 33/129; E21B 33/1291
See application file for complete search history.

(56) References Cited

U.S. PATENT DOCUMENTS 2,009,164 A * 7/1935 Colmerauer ..... E21B 23/01 166/211
2,221,797 A * 11/1940 Hertel ..... E21B 23/01 166/210
2,427,330 A * 9/1947 Spencer ..... E21B 43/10 166/208
3,419,079 A 12/1968 Current
4,311,196 A * 1/1982 Beall ..... E21B 33/129 166/134
4,359,090 A * 11/1982 Luke ..... E21B 33/1293 166/118
4,711,326 A 12/1987 Baugh et al.
4,762,177 A * 8/1988 Smith, Jr. ..... E21B 23/01 166/216
5,174,397 A * 12/1992 Currington ..... E21B 23/01 166/138
5,586,601 A 12/1996 Pringle
5,701,954 A 12/1997 Kilgore et al.
5,720,343 A 2/1998 Kilgore et al.
5,906,240 A 5/1999 Kilgore et al.
5,944,102 A 8/1999 Kilgore et al.
6,481,497 B2 11/2002 Swor et al.
7,198,110 B2 4/2007 Kilgore et al.
7,341,110 B2 3/2008 Doane et al.
(Continued)

FOREIGN PATENT DOCUMENTS

EP 19980306404 A2 2/1999
EP 20010305897 A2 1/2002
EP 0898048 B1 10/2004

OTHER PUBLICATIONS

International Search Report for PCT Application No. PCT/US2019/056565; dated Feb. 20, 2020; 3 pages.
(Continued)

*Primary Examiner* — Robert E Fuller
(74) *Attorney, Agent, or Firm* — Cantor Colburn LLP

(57) ABSTRACT

An anchor including a tubular body having a longitudinal axis, a number of wedges defined in the tubular body, the wedges having edges defined by surfaces at least one of the edges at a point along that edge having a first angle and at the same or another point along that edge having a second angle.

9 Claims, 4 Drawing Sheets

(56) References Cited

U.S. PATENT DOCUMENTS

| | | | | |
|---|---|---|---|---|
| 7,614,449 | B2 * | 11/2009 | Anderson | E21B 33/129 166/216 |
| 7,669,665 | B2 * | 3/2010 | Millet | F16L 55/136 166/382 |
| 8,291,989 | B2 | 10/2012 | Kilgore | |
| 8,307,891 | B2 * | 11/2012 | Bishop | E21B 33/1216 166/134 |
| 8,919,452 | B2 * | 12/2014 | Palmer | E21B 19/06 166/381 |
| 9,228,404 | B1 * | 1/2016 | Jackson | E21B 33/1295 |
| 9,291,029 | B2 * | 3/2016 | Lovslett | E21B 33/1293 |
| 9,644,452 | B2 * | 5/2017 | Jacob | E21B 34/14 |
| 10,184,313 | B2 * | 1/2019 | Cromer | E21B 33/129 |
| 10,619,446 | B2 * | 4/2020 | Webster | E21B 33/1293 |
| 2008/0264627 | A1 * | 10/2008 | Roberts | E21B 23/01 166/118 |
| 2009/0038808 | A1 | 2/2009 | Anderson | |
| 2013/0186650 | A1 | 7/2013 | Xu et al. | |
| 2017/0218711 | A1 | 8/2017 | Kash | |

OTHER PUBLICATIONS

Written Opinion for PCT Application No. PCT/US2019/056565; dated Feb. 5, 2020; 5 pages.

* cited by examiner

ANCHOR AND METHOD FOR MAKING

BACKGROUND

In the resource recovery industry, tools such as packers (seals), liner hangers, etc. need to be anchored to a wall of a tubular or the borehole in an open hole system. Slips have been used for such purposes with various configurations for decades and many work well for their intended purposes. It is however always a consideration of the clearance necessary to run a configuration with slips versus the robustness of the anchor that can be created. Often there is very little clearance. Also, anchors can be expensive to manufacture. The art then will be receptive to alternative configurations providing good anchoring capability economically.

SUMMARY

An anchor including a tubular body having a longitudinal axis, a number of wedges defined in the tubular body, the wedges having edges defined by surfaces at least one of the edges at a point along that edge having a first angle and at the same or another point along that edge having a second angle.

Method for making an anchor for a wellbore tool including forming a body having a longitudinal axis, forming a kerf in the body having a first angle at least at a point along the kerf and a second angle at least at the same point or a different point along the kerf relative to the longitudinal axis.

A wellbore tool including a tubular body having a longitudinal axis, a number of wedges defined in the tubular body, the wedges having edges defined by surfaces having two angles.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
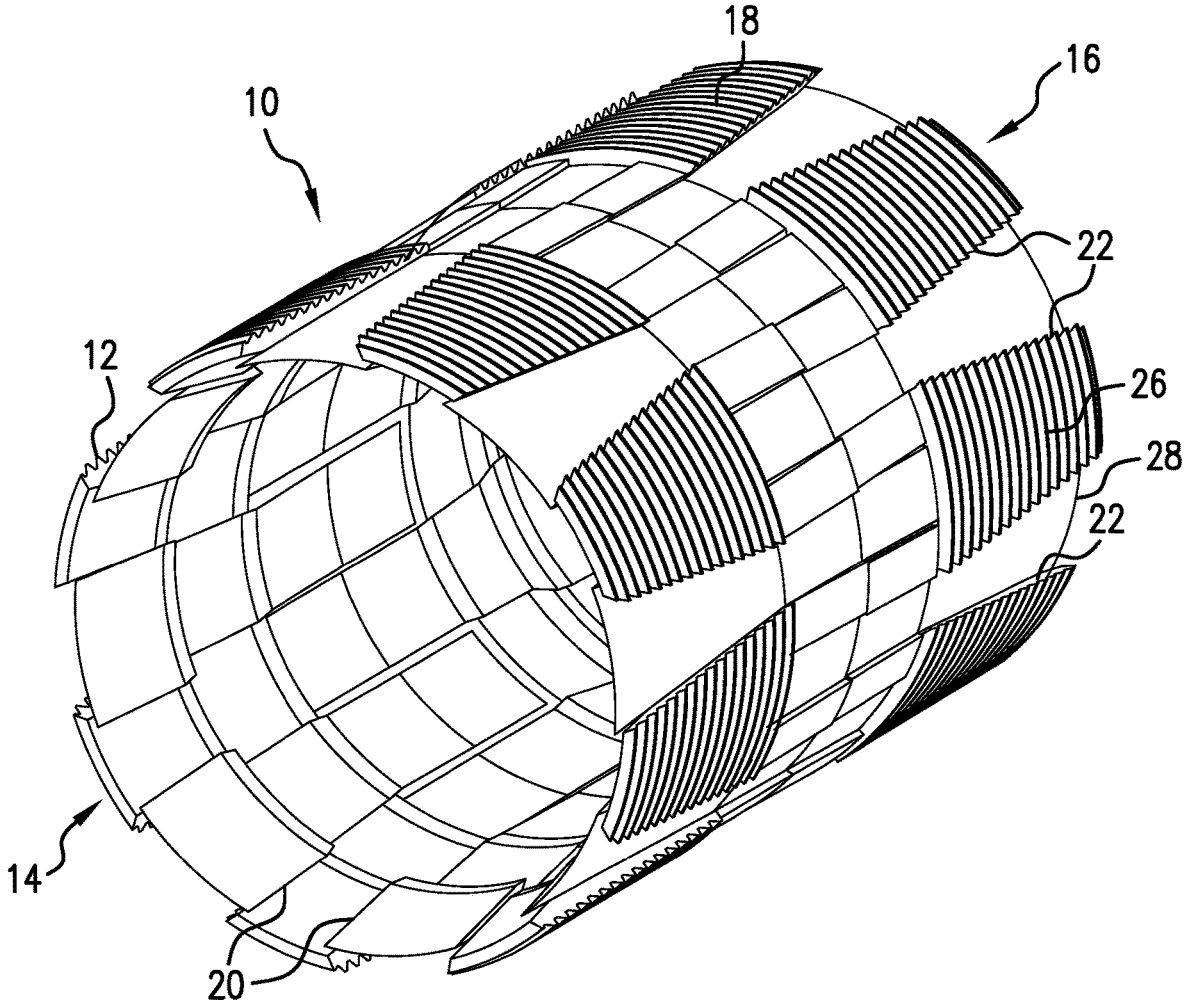
FIG. 1 is a perspective view of a slip body of an anchor as disclosed herein.
Figure 2:
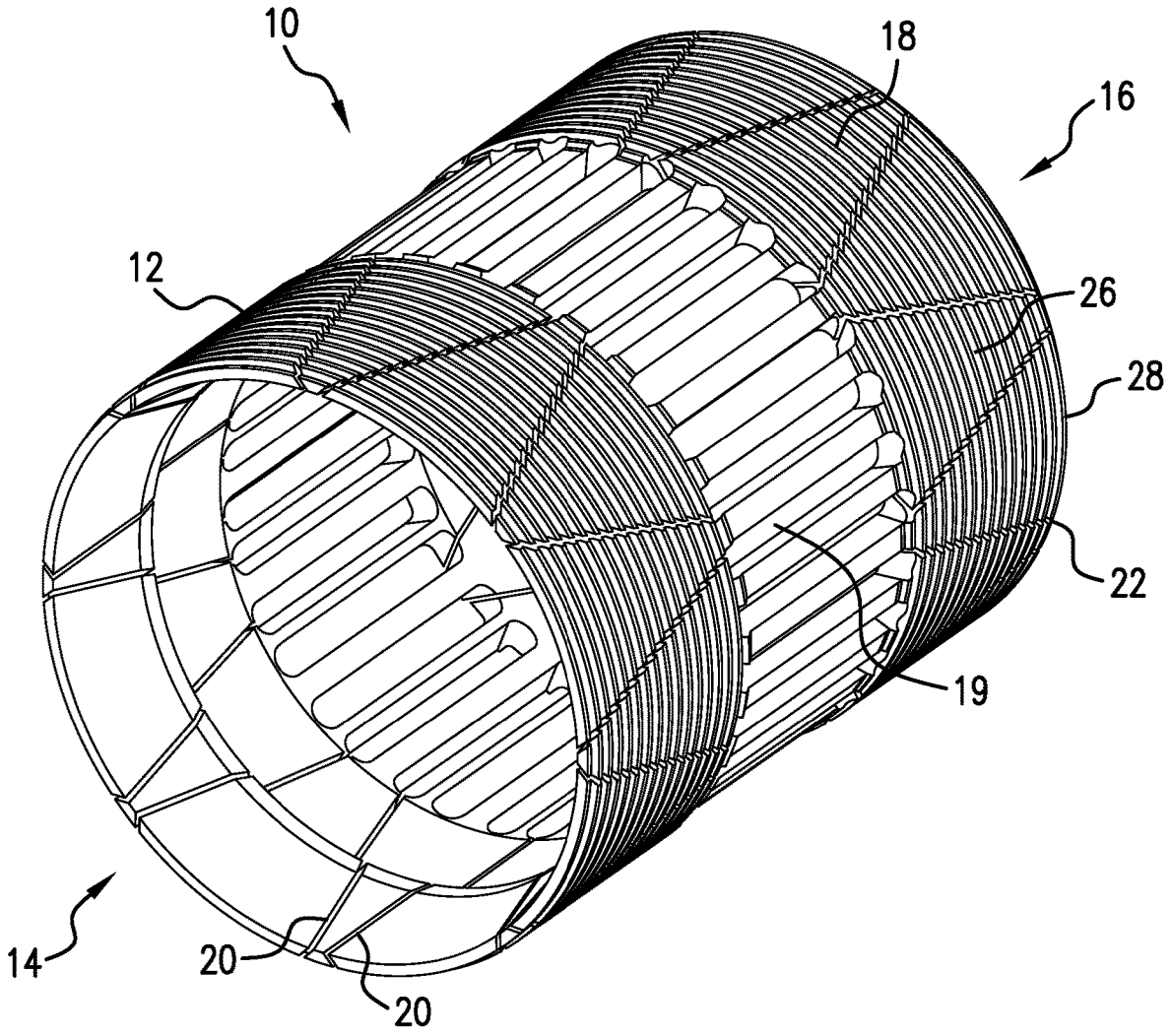
FIG. 2 is a perspective view of an alternate embodiment of an anchor as disclosed herein.

Referring to FIG. 1, a slip body 10 is illustrated in a perspective view. The body 10 includes wickers 12 on at least one end 14 and as shown at both ends 14 and 16 of the body 10 (wickers at end 16 are indicated with numeral 18). A pattern of kerfs are also visible in FIGS. 1 and 2 with FIG. 2 using greater helical angles (which increases axial load transfer and increases expansion potential) and illustrating slots 19 in the body as well that may be useful in some embodiments for fluid movement. It is to be appreciated that kerfs 20 begin at end 14 and kerfs 22 begin at end 16. Neither kerfs 20 nor kerfs 22 extend to both ends. Rather the kerfs 20 extend from end 14 into proximity with wickers 18 and kerfs 22 extend from end 16 into proximity with wickers 12. This leads to flexibility in the slip body 10 that allows a reduction in diameter and hence delivery through another tubular prior to setting.

Figure 3:
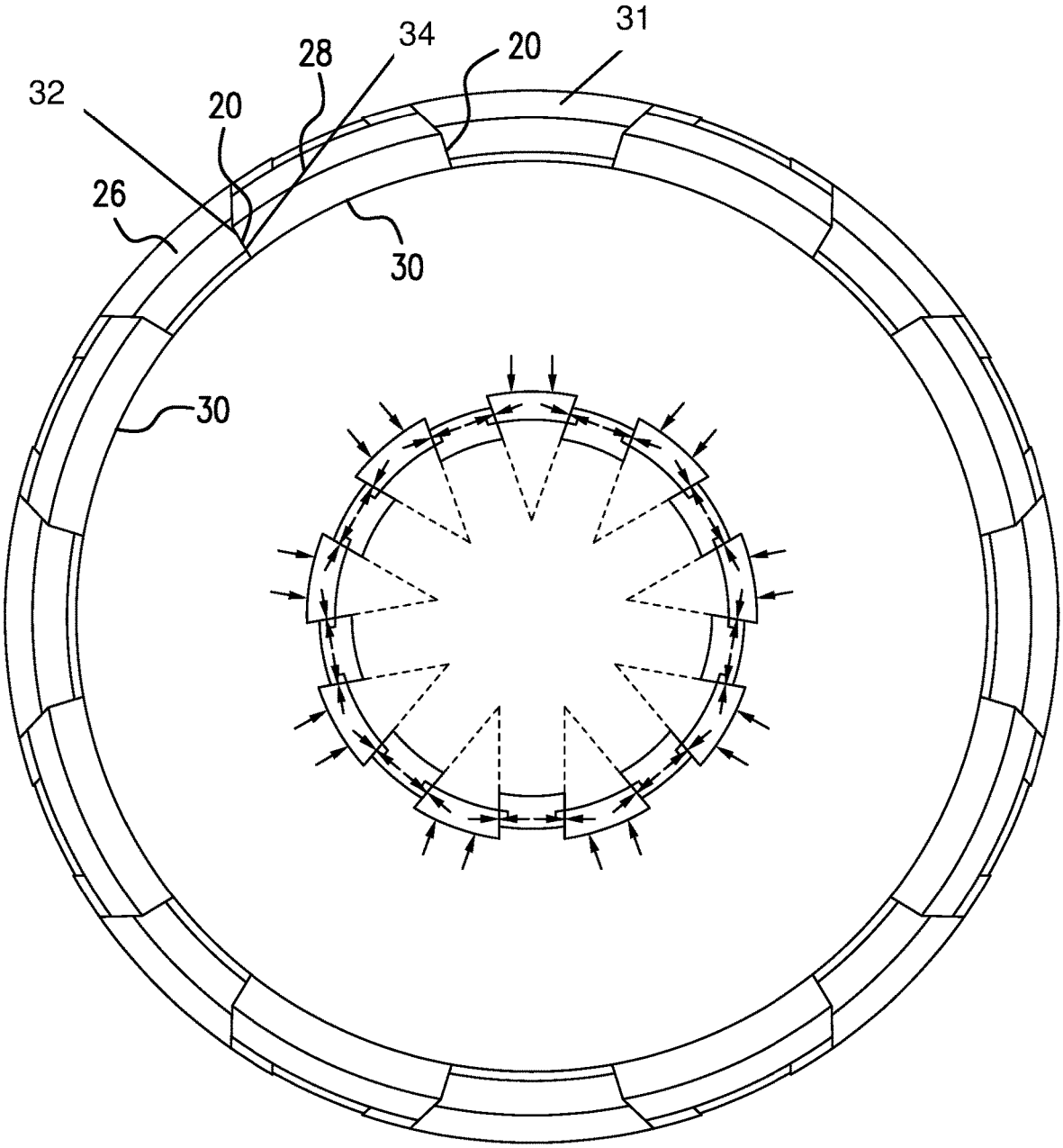
FIG. 3 is an end view of the slip body illustrated in FIG. 1.

The kerfs 20 and 22 at least in part are made in the body 10 at two angles each. Specifically, each kerf includes at least at a point along its length an angle other than radial through the body 10 and extends helically (at least for part of the kerf) along the body 10 (individual kerfs may then angle to extend axially as illustrated in FIG. 1, for example). In an embodiment, the angle may be from about 10 to about 45 degrees. It is noted for definitional understanding of this application that a line along a tube that is parallel to the longitudinal axis and extends along the tube from end to end of the tube and having the shortest possible length is nonhelical. If a line along a tube that is parallel to the longitudinal axis of the tube is at any angle other than the one just described, it is helical even if the line only extends a part of the distance along the tubular. This can be appreciated by considering FIG. 1, which illustrates the helical nature of the kerfs. FIG. 3 illustrates the nonradial nature of the kerfs. The helical angles of the kerfs create wedge shaped portions of body 20 so that axial forces are borne within the body 10 due to interference between adjacent parts of the body 10. It is to be appreciated that adjacent sections of body 10 form wedges 26 and 28 in opposing axial directions that can then bear against each other.

Focusing on FIG. 3, the nonradial kerfs allow for a substantial benefit in the diameter reduction capability of the body 10 for run in purposes. While it may be recognized that for a tubular with radial kerfs, the degree to which a reduction in diameter may be achieved is directly related to the kerf width because squeezing the hypothetical body with radial kerfs down to a smaller diameter will only go as far as the gaps of the kerfs allow before becoming a hoop again, the invention provides a greater ability to diametrically reduce. This is directly enabled by the nonradial kerfs of the body 10. FIG. 3 is illustrated in a compressed form and therefore shows alternate wedges 26 and 28 radially offset from each other. In other words, each of the wedges 28 are deflected radially inwardly of each of the wedges 26. Due to the nonradial nature of the kerfs 20, having an angle at least at a point along the length of the kerf of about 20 to about 50 degrees off of radial, a greater deflection is possible than if the kerfs were radially arranged. Moreover, the nonradial kerfs also enable the wedges 28 to urge the wedges 26 radially outwardly when a cone is positioned within the body 10 in a setting operation. The cone, (not shown) will contact radially inner surfaces 30 around the body 10 and drive the wedges 28 radially outwardly which has the effect of causing an edge or side surface 32 of a wedge 28 to push against the edge 34 or side surface of a wedge 26 urging the wedge 26 radially outwardly and increasing its circumferentially oriented force. It will be noted that side surfaces 32 and 43 are defined by the radially inner surface 30 and a radially outer surface 31 as shown in FIG. 3.

Another feature of the configuration of body 10 is that the radial force borne by the cone (not shown) is reduced from what it would be if the kerfs were radial because some of that force is borne circumferentially due to the nonradial kerfs. Force will tend to be borne closer to the normal to the angle of the kerfs 20 and that tends to be closer to tangential to the body 10. Such feature allows for greater collapse resistance and or reduction in body ruggedness without reduction in function. This also allows for a single size body 10 to be employed in a large number of casing diameters.

Figure 4:
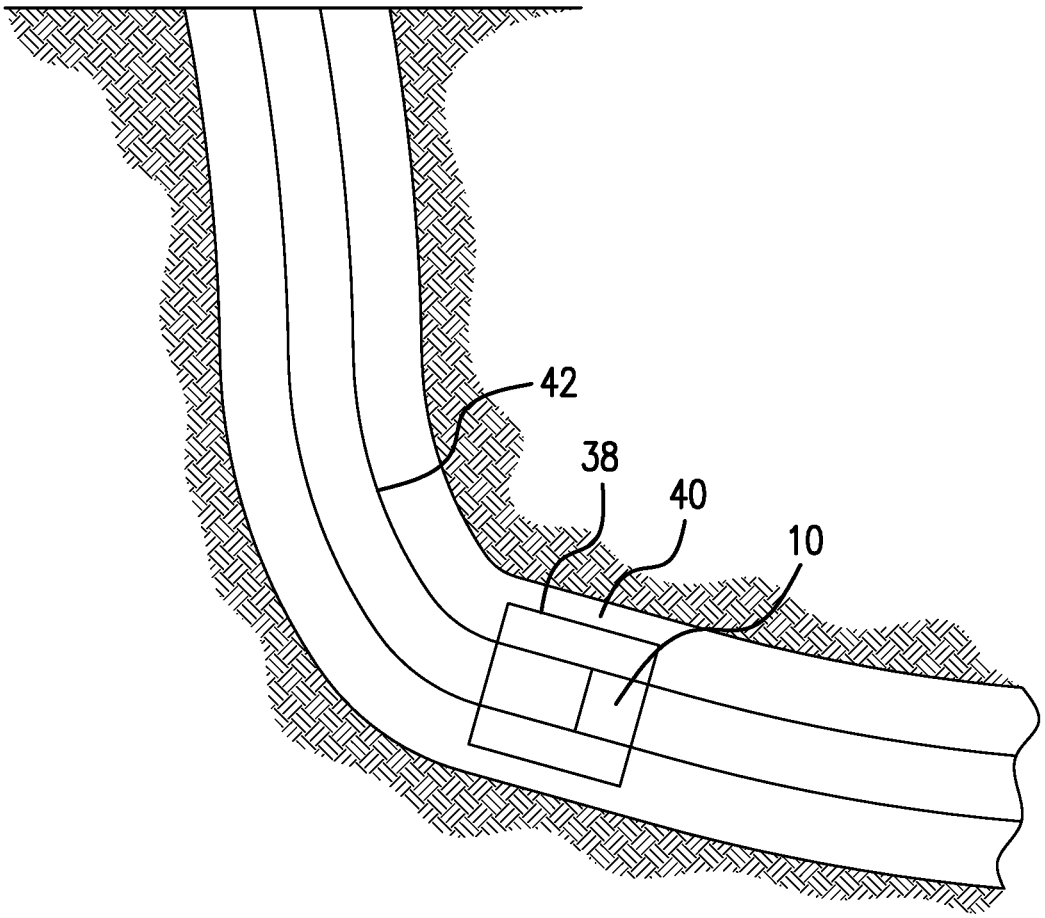
FIG. 4 is a schematic illustration of a wellbore tool in a borehole including the anchor as disclosed herein.

The anchor as disclosed herein may be part of a wellbore tool 38 such as a packer or hanger as collectively illustrated schematically in FIG. 4 or any other tool requiring that it be set and then stay in that position within a borehole 40 or other tubular structure. The tool 38 may be run on a string 42.

The anchor may be constructed using traditional subtractive manufacturing methods such as electric discharge machining (EDM); mechanical material removal, etc. or can be created using an additive manufacturing method.

Set forth below are some embodiments of the foregoing disclosure:

Embodiment 1

An anchor including a tubular body having a longitudinal axis, a number of wedges defined in the tubular body, the wedges having edges defined by surfaces at least one of the edges at a point along that edge having a first angle and at the same or another point along that edge having a second angle.

Embodiment 2

The anchor as in any previous embodiment wherein the first angle is a nonradial angle relative to the axis.

Embodiment 3

The anchor as in any previous embodiment wherein the nonradial angle is in a range of about 20 to about 50 degrees.

Embodiment 4

The anchor as in any previous embodiment wherein the second angle is a helical angle relative to the axis.

Embodiment 5

The anchor as in any previous embodiment wherein the helical angle is in a range of about 10 to about 45 degrees.

Embodiment 6

Method for making an anchor for a wellbore tool including forming a body having a longitudinal axis, forming a kerf in the body having a first angle at least at a point along the kerf and a second angle at least at the same point or a different point along the kerf relative to the longitudinal axis.

Embodiment 7

The method as in any previous embodiment further including forming wickers on an outside surface of the body.

Embodiment 8

The method as in any previous embodiment wherein the forming is by subtractive manufacturing.

Embodiment 9

The method as in any previous embodiment wherein the forming is by additive manufacturing.

Embodiment 10

The method as in any previous embodiment wherein one of the two angles of the kerf is nonradial at least at a point along the kerf relative to the longitudinal axis.

Embodiment 11

The method as in any previous embodiment wherein a second of the two angles is helical at least at a point along the kerf relative to the longitudinal axis.

Embodiment 12

A wellbore tool including a tubular body having a longitudinal axis, a number of wedges defined in the tubular body, the wedges having edges defined by surfaces having two angles.

Embodiment 13

A wellbore including a borehole in a formation, an anchor as in any previous embodiment disposed within the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity and up to a 10 percent variation).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An anchor comprising:

a tubular body having a longitudinal axis;

a plurality of first wedges and a plurality of second wedges comprising the body, the plurality of first wedges and plurality of second wedges being axially fixed relative to one another, at least one of the plurality of first wedges and plurality of second wedges having wickers defined in the tubular body, one of the plurality of first wedges or plurality of second wedges having contact surfaces configured for interaction with a cone, the plurality of first wedges and plurality of second wedges having planar side surfaces extending from and bounded by radially inner and radially outer surfaces of the plurality of first wedges and plurality of second wedges, at least one of the planar side surfaces, along that planar side surface having a first nonradial angle and a second helical angle relative to the axis plurality of first wedges and plurality of second wedges configured to bear radial force and circumferential force against each other through the nonradial angle, during use.

2. The anchor as claimed in claim 1 wherein the nonradial angle is in a range of about 20 to about 50 degrees off of radial.

3. The anchor as claimed in claim 1 wherein the helical angle is in a range of about 10 to about 45 degrees off of nonhelical.

4. A wellbore comprising:

a borehole in a formation;

an anchor as claimed in claim 1 disposed within the borehole.

5. Method for making an anchor for a wellbore tool comprising:

forming a tubular body having a longitudinal axis;

forming kerfs in the tubular body to create a plurality of first wedges and a plurality of second wedges, the plurality of first wedges and plurality of second wedges being axially fixed relative to one another, one of the plurality of first wedges or plurality of second wedges having contact surfaces configured for interaction with a cone, the kerfs having a first nonradial angle along each kerf and a second helical angle along each kerf relative to the longitudinal axis the plurality of first wedges and plurality of second wedges configured to bear radial force and circumferential force against each other through the nonradial angle, during use.

6. The method as claimed in claim 5 further including forming wickers on an outside surface of the body.

7. The method as claimed in claim 5 wherein the forming of at least one of the body and the kerf is by subtractive manufacturing.

8. The method as claimed in claim 5 wherein the forming of the body is by additive manufacturing.

9. A wellbore tool comprising:

a tubular body having a longitudinal axis;

a cone disposed adjacent the tubular body, and a plurality of first wedges and a plurality of second wedges comprising the body, the plurality of first wedges and plurality of second wedges being axially fixed relative to one another, at least one of the plurality of first wedges and plurality of second wedges having wickers defined in the tubular body, one of the plurality of first wedges or plurality of second wedges having contact surfaces configured for interaction with the cone, the plurality of first wedges and plurality of second wedges having planar side surfaces extending from and bounded by radially inner and radially outer surfaces of the plurality of first wedges and plurality of second wedges, at least one of the planar side surfaces, along that planar side surface having a first nonradial angle and a second helical angle relative to the axis the plurality of first wedges and plurality of second wedges configured to bear radial force and circumferential force against each other through the nonradial angle, during use.

* * * * *